US006547328B2

(12) United States Patent
Liu

(10) Patent No.: US 6,547,328 B2
(45) Date of Patent: Apr. 15, 2003

(54) DUAL ROW OUTDOOR LEISURE ROCKING CHAIR

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/818,675

(22) Filed: Mar. 28, 2001

(65) Prior Publication Data

US 2002/0140261 A1 Oct. 3, 2002

(51) Int. Cl.[7] ..... A47C 15/00
(52) U.S. Cl. ..... 297/245; 297/273; 472/125
(58) Field of Search ..... 297/273, 277, 297/247, 245; 472/125

(56) References Cited

U.S. PATENT DOCUMENTS 709,110 A * 9/1902 Olson ..... 297/245
1,156,189 A * 10/1915 Stohler ..... 297/245
2,097,905 A * 11/1937 Weaver ..... 297/245
3,825,299 A * 7/1974 Gaucher ..... 297/157
4,620,702 A * 11/1986 Hemmeter ..... 272/85
5,842,741 A * 12/1998 Onorini ..... 297/281
5,902,187 A * 5/1999 Boring ..... 472/125

* cited by examiner

*Primary Examiner*—Peter M. Cuomo
*Assistant Examiner*—Stephanie Harris

(57) ABSTRACT

A dual row outdoor leisure rocking chair. The chair includes two rocking chairs each having a main frame with two foot supports linked by a linking bar at the bottom side. The main frame hangs a swingable loading bracket thereon. The loading bracket has two bottom sides each engaged with a linkage rod. A top bracket is mounted at the top end of the main frame. The top bracket has a coupling section formed at one end thereof. The two rocking chairs are opposite to each other and swingable synchronously in a coupled fashion, and may be assembled easily.

8 Claims, 5 Drawing Sheets

DUAL ROW OUTDOOR LEISURE ROCKING CHAIR

BACKGROUND OF THE INVENTION

This invention relates to a dual row outdoor leisure rocking chair and particularly a leisure rocking chair that is swingable synchronously and easy to assemble and has an attractive appearance.

A conventional dual row rocking hair (as shown in FIG. 1) generally has a frame which is made by soldering a plurality of supports. The frame has two sets of chair pivotally mounted thereon in two rows to attain swing effect for seating four persons.

As the frame and supports are fastened by soldering, the assembly process is tedious. Moreover soldering work always leaves untidy spots and results in not attractive overall appearance.

SUMMARY OF THE INVENTION

In view of aforesaid disadvantages, it is therefore an object of this invention to provide an improved dual row outdoor leisure rocking chair that is swingable synchronously and is easy to assemble and has an attractive appearance.

To attain aforesaid object, the rocking chair according to this invention has a main frame mounted on two foot supports which have respectively a bottom side connected by a linking bar. There is a swingable loading bracket hanging on the main frame. The loading bracket has two bottom sides each attached to a linkage rod. At the top end of the frame, there is a top bracket mounted thereon. The top bracket has a fastening lug. Applying similar structure set forth above, another rocking chair may be made including two foot supports, a loading bracket and a top bracket. Then the two sets of rocking chair may be mounted and opposite to each other to form a leisure rocking chair that is able to swing synchronously for outdoor use.

The invention, as well as its many advantages, may be further understood by the following detailed description and drawings.

DETAILED DESCRIPTION OF THE PREFERRED EMBODIMENT

Figure 1:
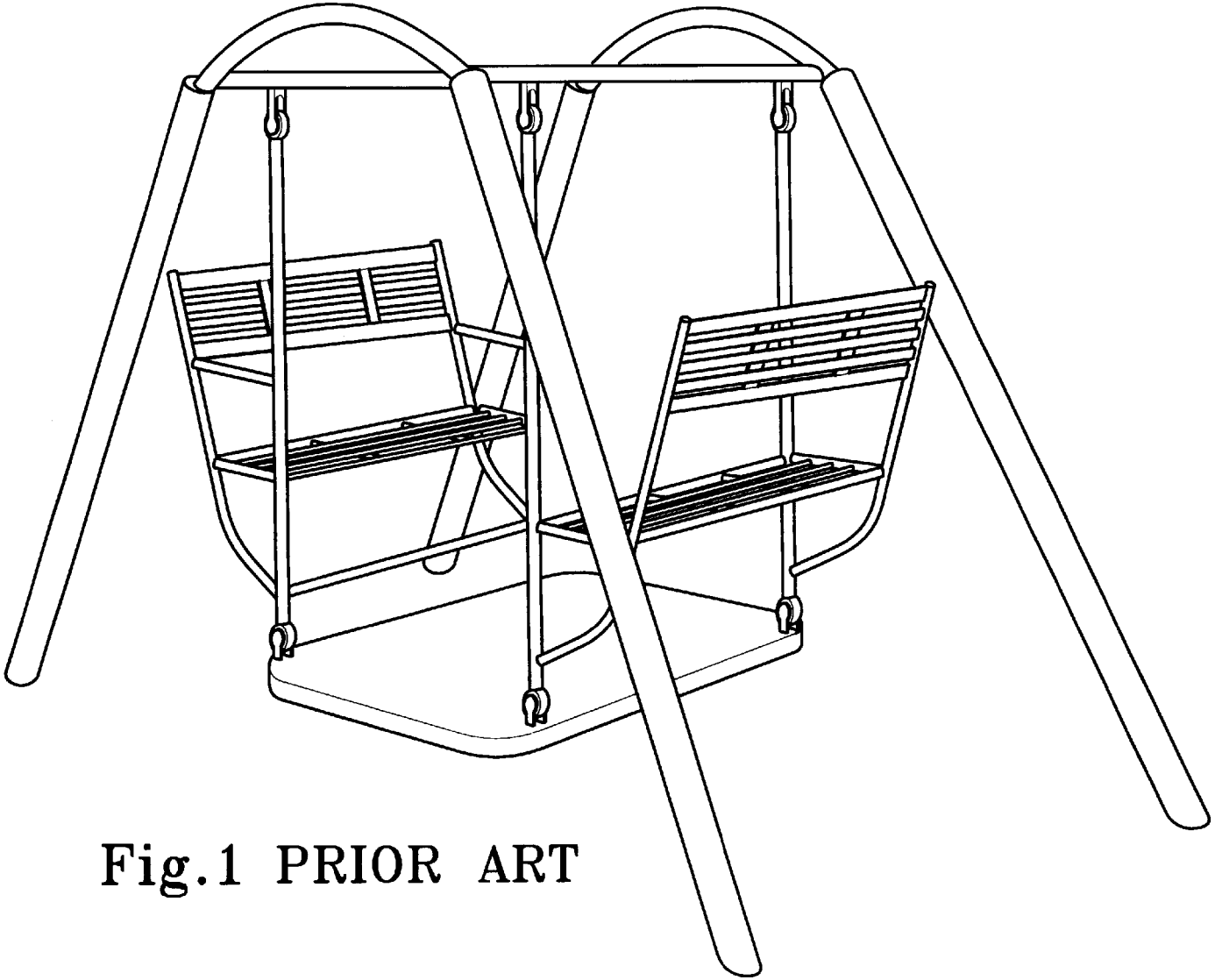
Fig.1 PRIOR ART
FIG. 1 is a pictorial view of a conventional dual row rocking chair.
Figure 2:
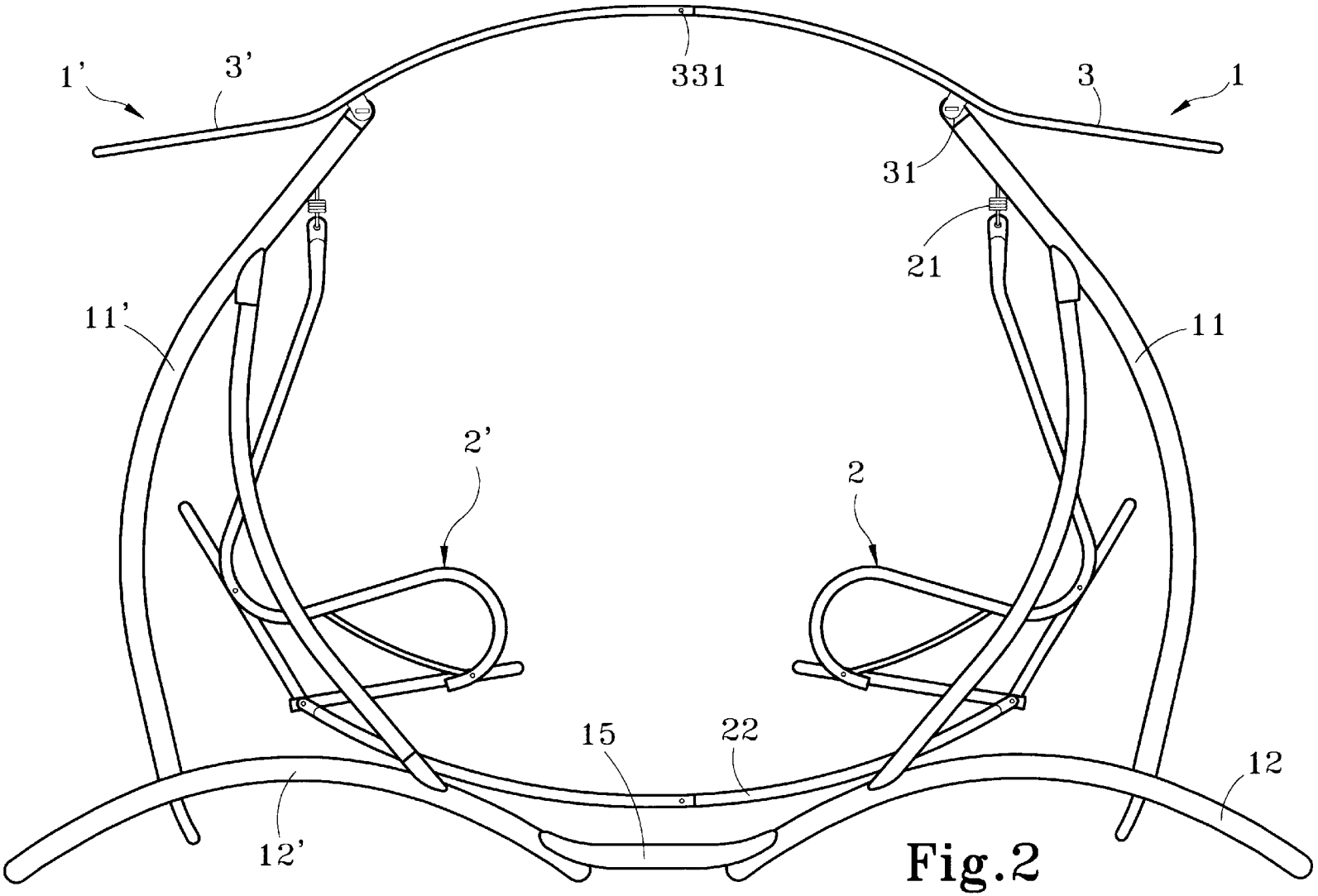
FIG. 2 is a side view of this invention.
Figure 3:
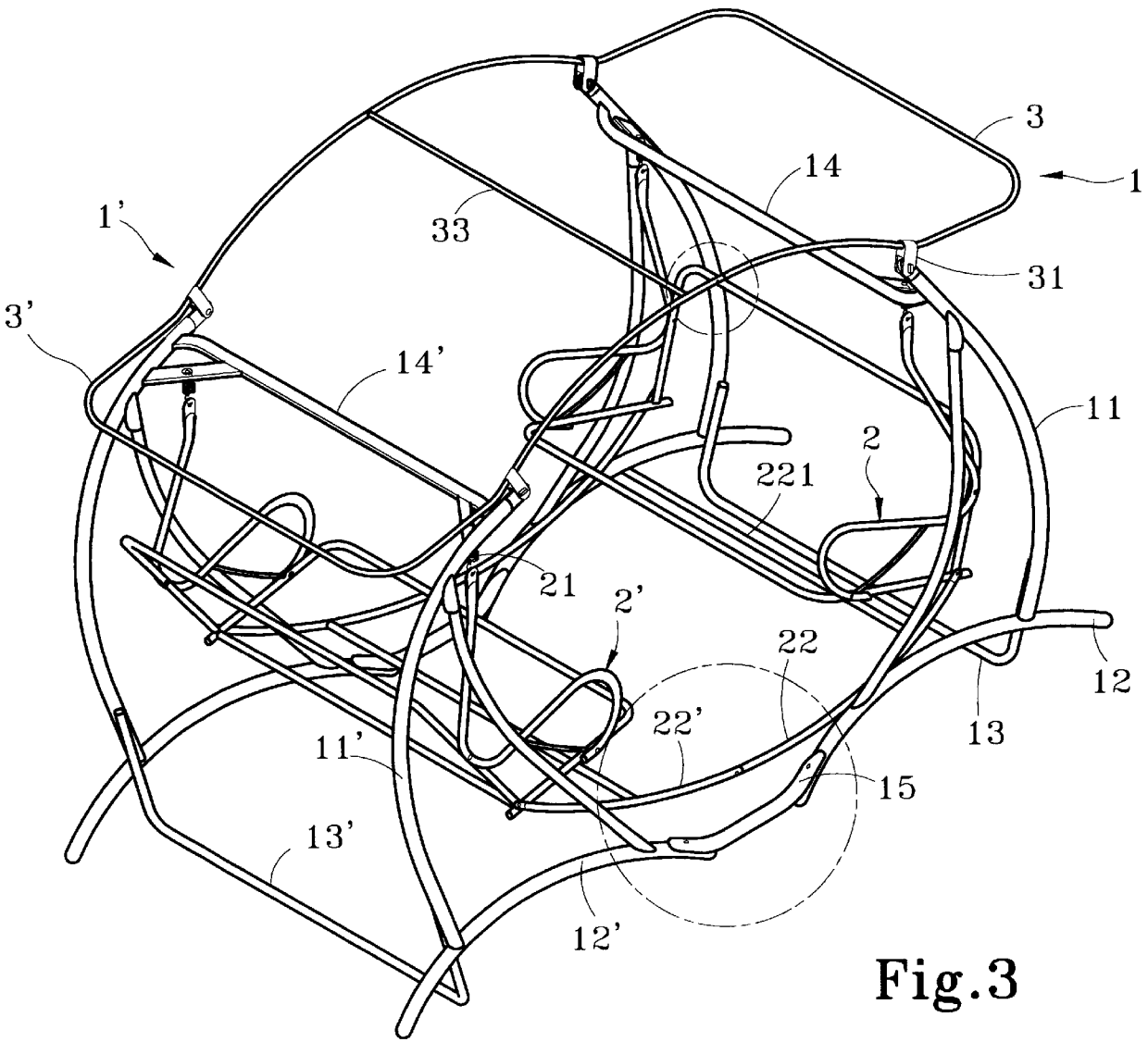
FIG. 3 is a perspective view of this invention.

Referring to FIGS. 2 and 3, the rocking chair 1 according to this invention includes a main frame 11 which has two foot supports 12. The main frame 11 has two reinforced bars 13 and 14 bridged two sides thereof at an upper and a lower end respectively for increasing the strength of the main frame 11. The bottom side of the two foot supports 12 are connected by a linking bar 15. A loading bracket 2 is hung on the main frame 11 between the foot brackets 12 by an elastic element 21. At two bottom sides of the loading bracket 2, there is respectively a linkage rod 22. The linkage rods 22 at two sides are bridged by a transverse stretcher 221 for increasing the strength of the linkage rods 22. At the top end of the main frame 11, there is a top bracket 3 located at one side. The top bracket 3 has a fastening lug 31 engaged with one end of the main frame 11. The top bracket 3 has a transverse top stretcher 33 bridged two sides thereof. The transverse top stretcher 33 is fastened to the top bracket 3 through a fastening element 331. The top bracket 3 further has a coupling section 32 formed at one end thereof. Applying similar construction set forth above, another set of rocking chair 1' may be built with another main frame 11' mounted on two foot supports 12', a loading bracket 2' and a top bracket 3'. Then the two chairs 1 and 1' may be coupled to form a dual row outdoor leisure rocking chair of this invention. The chair 1' also has two reinforced bars 13' and 14' bridged the main frame 11' at two sides at the upper and lower ends thereof. The rocking chair thus built may be assembled easily and has attractive appealing.

Figure 4:
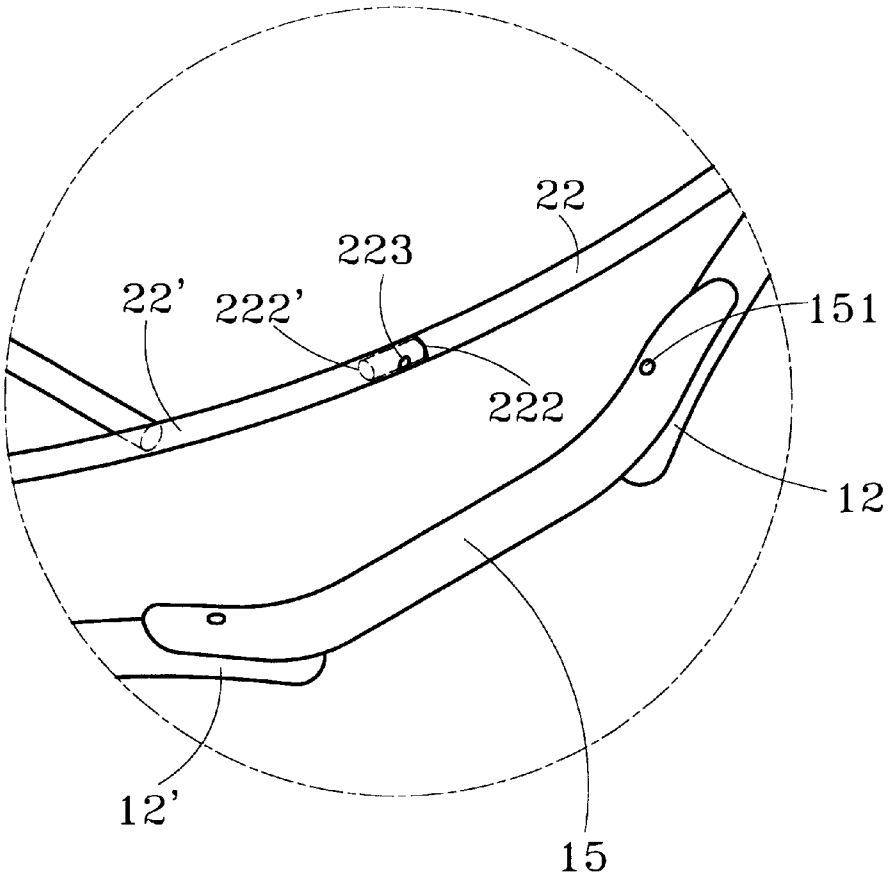
FIG. 4 is a fragmentary enlarged schematic view of this invention, according to FIG. 3.

Referring to FIG. 4, the linking bar 15 between the foot supports 12 and 12' may be fastened by soldering or riveting through a rivet 151. The linkage rods 22 and 22' have respectively a coupling section 222 and 222' formed at one end thereof The coupling section 222 has an outside diameter smaller than the inside diameter of another coupling section 222' for the linkage rods 22 and 22' to engage with each other in a male and female coupling fashion. The coupled section is fastened by a fastener 223.

Figure 5:
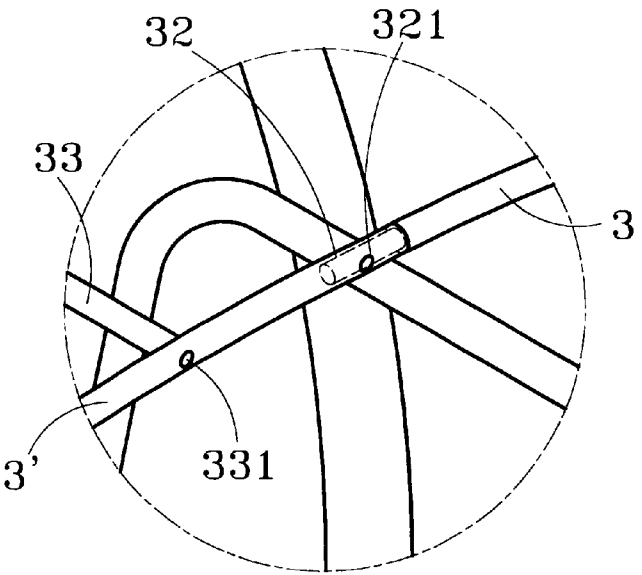
FIG. 5 is another fragmentary enlarged schematic view of this invention, according to FIG. 3.

Referring to FIG. 5, at one end of the top bracket 3, there is a coupling section 32 which has an outside diameter smaller than the inside diameter of another coupling section of the top bracket 3' so that the top bracket 3 and 3' may engage with each other in a male and female coupling fashion. The coupled section is fastened by a fastener 321.

Figure 6:
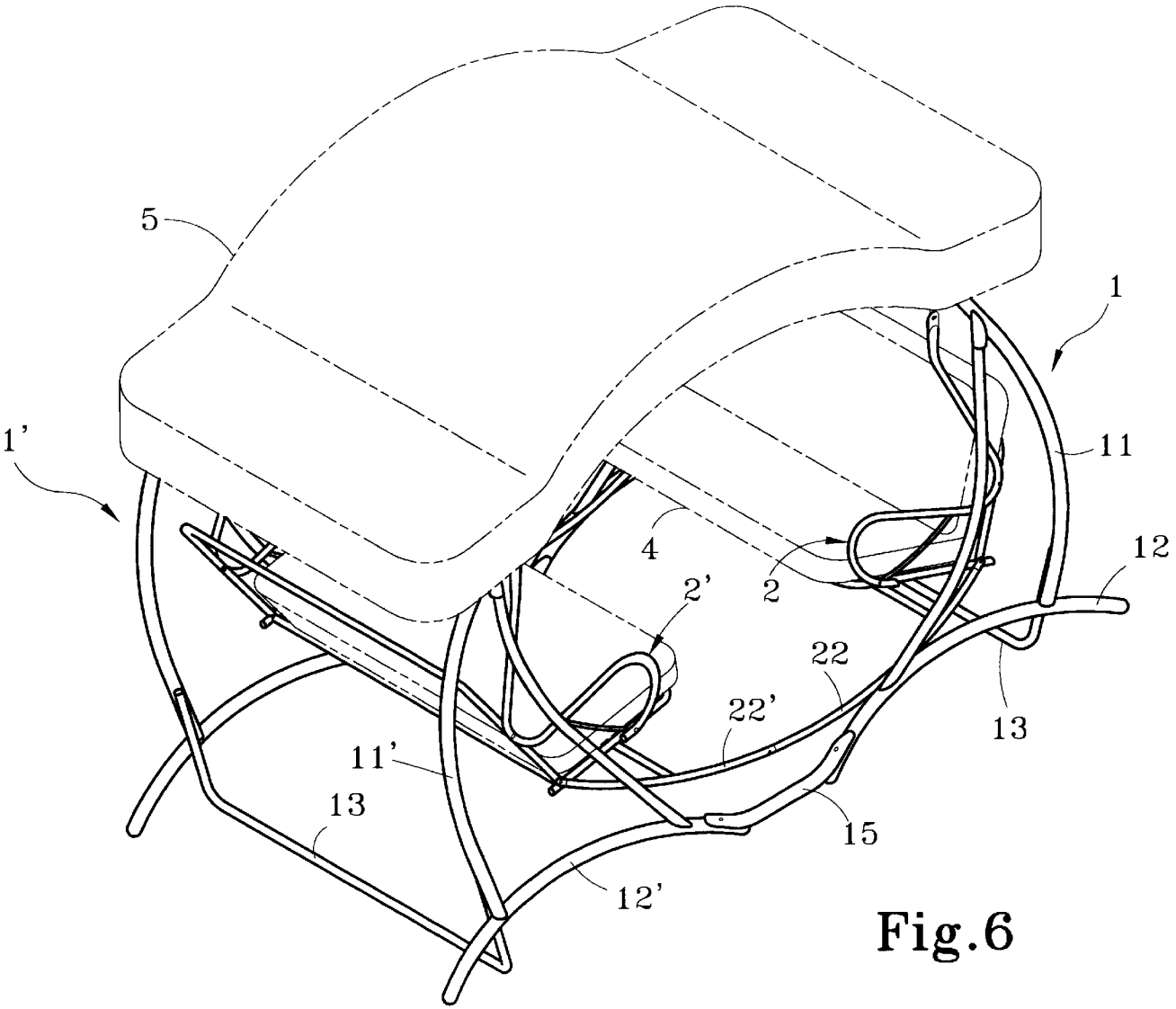
FIG. 6 is a pictorial view of this invention in use.

Referring to FIG. 6, when the rocking chair of this invention is assembled, a chair pad 4 may be disposed respectively on the loading bracket 2 and 2'. A waterproof canvas canopy 5 may be disposed on the top bracket 3 and 3' to shield sunshine or guard rainfall.

What is claimed is:

1. A dual row outdoor leisure rocking chair including a first rocking chair and a second rocking chair;

the first rocking chair comprising a main frame which has two foot supports, each of the foot supports has a bottom side attached to a linking bar, the main frame hanging a swingable loading bracket which has two bottom sides each engaged with a linkage rod;

a top bracket located at a top end of the main frame, the top bracket having a coupling section formed at one end thereof;

the second rocking chair being substantially constructed as the first rocking chair and comprising two foot supports, a loading bracket and a second top bracket, the first and second rocking chairs being opposite to each other in two rows and swingable synchronously in a coupled fashion; and wherein the linkage rods are fastened by engaging a male coupling section with a female coupling section, and the linkage rods being spaced apart and bridged by a transverse stretcher adapted for reinforcement of the linkage rods.

2. The dual row outdoor leisure rocking chair of claim 1, wherein each of the main frames further comprise two reinforced bars that bridge two sides thereof.

3. The dual row outdoor leisure rocking chair of claim 1, wherein the linking bars are fastened to respective ones of the foot supports by soldering or riveting.

4. The dual row outdoor leisure rocking chair of claim 1, wherein the loading brackets are hung by an elastic element on the main frame and has a chair pad disposed thereon.

5. The dual row outdoor leisure rocking chair of claim 1, wherein the main frame has one end fastened to the top bracket through a fastening lug.

6. The dual row outdoor leisure rocking chair of claim 1, wherein the top bracket has a coupling section to fasten with each other in a male and female coupling fashion.

7. The dual row outdoor leisure rocking chair of claim 1, wherein the top bracket has a transverse top stretcher bridged therebetween, the top stretcher being fastened by a fastening element.

8. The dual row outdoor leisure rocking chair of claim 1, wherein the top bracket being covered by a waterproof canvas canopy.

* * * * *